United States Patent [19]

Frei

[11] 4,080,789

[45] Mar. 28, 1978

[54] STEAM GENERATOR

[75] Inventor: Dieter Frei, Seuzach, Switzerland

[73] Assignee: Sulzer Brothers Limited, Winterthur, Switzerland

[21] Appl. No.: 726,068

[22] Filed: Sep. 24, 1976

[30] Foreign Application Priority Data

Sep. 26, 1975 Switzerland ..... 12551/75

[51] Int. Cl.[2] ..... F01K 3/22

[52] U.S. Cl. ..... 60/658; 60/667; 122/406 ST

[58] Field of Search ....., 60/664–667, 60/658, 656, 657, 646; 122/406 S, 406 ST

[56] References Cited

U.S. PATENT DOCUMENTS

| | | | |
|---|---|---|---|
| 3,286,466 | 11/1966 | Stevens | 60/658 X |
| 3,774,396 | 11/1973 | Borsi et al. | 60/667 X |
| 3,965,675 | 6/1976 | Martz et al. | 122/406 X |

*Primary Examiner*—Allen M. Ostrager
*Assistant Examiner*—Stephen F. Husar
*Attorney, Agent, or Firm*—Kenyon & Kenyon, Reilly, Carr & Chapin

[57] ABSTRACT

A line is connected to a branch point between the gas-heated preheater and evaporator to deliver heated feed water to the supply tank while control valves are placed in the feed line to the preheater and the line to the supply tank. These valves are controlled by a temperature measuring means adjacent the branch point. If the measured temperature increases, the flow of feed water to the preheater increases.

10 Claims, 2 Drawing Figures

STEAM GENERATOR

Figure 1:
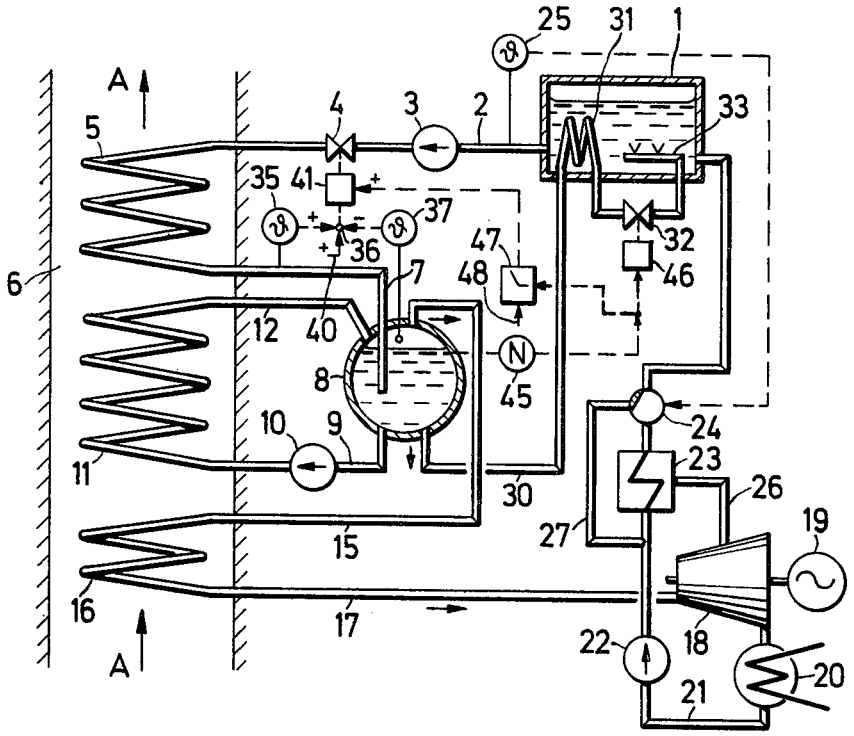

This invention relates to a steam generator.

As is known, steam generators have been constructed with a feed water preheater and an evaporator in the path of a heat-dispensing medium such as a hot gas with the preheater being supplied with feed water from a supply tank via a pump. The feed water preheater (frequently called an economizer) in such a steam generator usually functions to warm up the feed water to nearly the evaporation temperature in order to lower the exit temperature of the gas from the steam generator as far as possible and, thus, improve the use of the heat contained in the hot gas. From the point of view of fuel utilization, it is desirable to keep the difference between the feed water temperature at the exit of the gas-heated preheater and the evaporation temperature as small as possible. This would allow the feed water to absorb a maximum of heat.

During a partial-load operation of these steam generators, the amount of feed water flowing through the gas-heated preheater is usually decreased. At the same time, heat absorption is increased because the temperature differences between the hot gas and the feed water upstream of the preheater become larger. For this reason, there is a danger that steam may develop in the feed water preheater. Should steam occur, this can lead to instability phenomena and cavitation shock in the tube system of the preheater in which the flow is usually downward.

In order to avoid such disadvantages, it has been known to either reduce the heating surface of the preheater or to connect the preheater in such a manner that the feed water flows through in an upward direction. Under the assumption, which is generally met in gas-heated steam generators, that the hot gas flows through the steam generator in an upward direction, both measures have an adverse effect on the above-mentioned difference between the exit temperature of the preheater and the evaporation temperature and, therefore, on fuel utilization. Another possibility of avoiding the formation of steam in the preheater is a gas bypass. Although this measure permits the steam generator to be operated with a small temperature difference, stringent requirements are imposed on the construction of the steam generator. This measure is also expensive.

Accordingly, it is an object of the invention to improve a steam generator of the combustion chamber or gas-heated type in such a manner that steam formation in the gas-heated feed water preheater is reliably prevented.

It is another object of the invention to provide a simple control means to prevent steam formation in a gas-heated preheater of a steam generator.

It is another object of the invention to provide an economical means of controlling the flow of feed water to a gas-heated preheater of a steam generator.

Briefly, the invention is directed to a steam generator which comprises an evaporator for evaporating feed water to steam, a feed water preheater for preheating a flow of feed water therein, a tank containing feed water and a feed pump connected between the tank and preheater for pumping feed water from the tank to the preheater. Both the evaporator and preheater are disposed in a flow path of hot gas with the preheater downstream of the evaporator relative to the flow of hot gas. In accordance with the invention, a line is connected to a branch point between said preheater and said evaporator for taking off heated feed water and is connected to the supply tank to deliver the heated feed water to the tank. Also, a control means is provided for increasing the amount of feed water flowing through the preheater and the branch line in response to an increase in temperature of the feed water in the preheater and for decreasing the amount of feed water in response to a decrease in temperature. This control means includes a temperature measuring means adjacent the branch point for measuring the temperature of the feed water passing from the preheater.

By branching off a flow of heated feed water between the preheater and the evaporator, an increase of the throughput of feed water through the gas-heated preheater can be accomplished as a function of the temperature measured in the vicinity of the branching point of this line. Thus, steam formation can be precluded in the preheater. At the same time, the difference between the temperature of the feed water at the preheater exit and the evaporation temperature is maintained at a minimum for all loads. This improves the fuel utilization.

The heat which is returned to the tank due to the increased throughput through the preheater can be used to generate steam in the tank, which steam can then be fed to a low-pressure stage of a steam turbine. Alternatively, the heat can be used to preheat the feed water in the tank and/or for preheating the condensate from the turbine, so that the consumption of extraction steam is reduced and thereby, a larger amount of steam is available in the steam turbine to perform work.

In addition, the control means has a control valve or like element between the pump and preheater for controlling the amount of feed water pumped to the preheater. The temperature measuring means is connected to this valve to open the valve in response to an increase in feed water temperature in the preheater and to close the valve in response to a decrease in feed water temperature in the preheater. Alternatively, the temperature measuring means may be connected to the feed pump to control the output of the pump. Also, a throttling means is placed in the branch line for controlling the flow of heated feed water to the tank. This throttling means is also controlled by the control means. For example, where the steam generator has a steam/water drum connected between the preheater and evaporator the control means has a level measuring means for measuring the level of water in the drum. This level measuring means is then connected to the throttling means in the branch line to increase the flow of heated feed water to the tank in response to an increase in water level in the drum and to decrease the flow in response to a decrease in water level.

Figure 2:
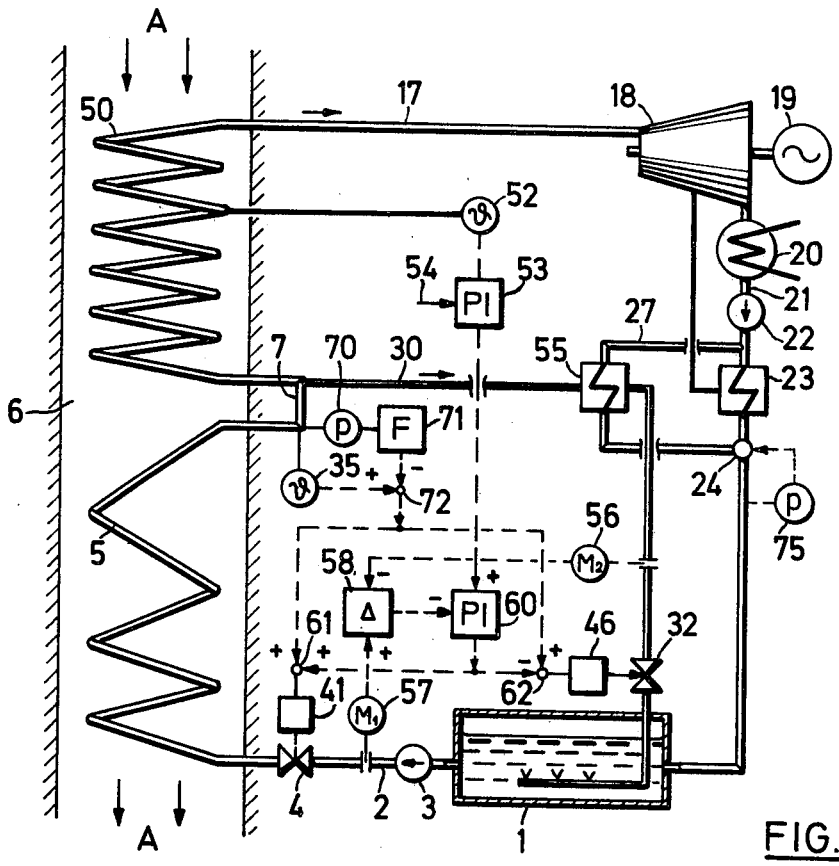

These and other objects and advantages of the invention will become more apparent from the following detailed description and appended claims taken in conjunction with the accompanying drawings in which:

FIG. 1 illustrates a schematic diagram of a steam generator according to the invention with a steamwater drum; and FIG. 2 illustrates a schematic diagram of a steam generator according to the invention which operates according to the forced circulation principle.

Referring to FIG. 1, the steam generator is constructed with a feed water preheater or economizer 5, an evaporator 11 and a superheater 16 each of which is disposed in a duct 6 which defines a flow path A for hot gas. As shown, the preheater 5 is disposed in the flow path A downstream of the evaporator 11 relative to the flow of hot gas. The hot gas heats the heating surfaces 5, 11, 16 by convection and may come from a gas turbine, a process installation or also from a gas-cooled nuclear reactor. The steam generator also has a steam/-water drum 8 between the preheater 5 and evaporator 11.

As shown, the steam generator employs a tank 1 from which feed water is pumped by means of a feed pump 3 via a feed line which contains a feed valve 4 into the preheater 5. A line 7 leads from the preheater 5 into the steam-water drum 8 to convey the heated feed water while a line 9 leads from the drum 8 to the evaporator 11 via a circulating pump 10 to deliver feed water to the evaporator 11. The steam water mixture generated in the evaporator 11 is conducted via a line 12 into the steam space of the drum 8. A line 15 is connected to the steam space and leads to the superheater 16 which is connected via a main steam line 17 to a steam turbine 18 driving an electric generator 19. The outlet of the steam turbine 18 is connected to a condensor 22 from which a condensate line 21 leads via a condensate pump 22, a condensate preheater 23 and a three-way valve 24 to the feed water tank 1. The condensate preheater 23 is heated in normal operation with extraction steam from the steam turbine 18, which is fed-in via a line 26. The condensate preheater 23 can be bypassed on the condensate side by means of the three-way valve 24 and a bypass line 27. The three-way valve 24 is under the influence of a temperature measuring device 25 connected to the feed line 2.

In addition to the line 9 which leads to the evaporator 11, a line 30 branches from the drum 8 and leads to the feed water tank 1. The line 30 passes into the tank 1 to form a cooler 31 and then terminates in the tank 1 below the water level in the tank 1 in the form of a distributor pipe 33. This line 30 serves to deliver heated feed water to the tank 1. A throttling means 32 such as a valve is also disposed in this line 30 downstream of the cooler 31 for controlling the flow of heated feed water delivered to the tank 1.

A control means for increasing or decreasing the amount of feed water flowing through the preheater 5 and line 30 in response to the temperature of the feed water in the preheater 5 includes a temperature measuring means 35 which is connected to the line 7 which leads from the feed water preheater 5 to the steam-water drum 8. This temperature measuring means 35 has a signal output which is connected to an adding point 36 to deliver a signal representative of the temperature of the feed water in the line 7. The control means also has a temperature measuring means 37 connected to the drum 8. This latter measuring means 37 also has an output which is likewise connected to the adding point 36 to deliver a signal representative of the steam temperature in the steam space of the drum 8. A load-dependent difference signal is fed to the adding point 36 via a signal line 40 from a signal transmitter (not shown). The output of the adding point 36 leads to the input of a controller 41, preferably with a PI characteristic, the output of which is in operative connection with the feed valve 4.

The control means also has a level measuring means 45 connected to the drum 8 to deliver a signal representative of the water level in the drum 8 via a signal output to a controller 46 which acts on the throttling means 32 in the line 30. The signal output of the level measuring means 45 is also connected to a limiter 47 parallel to the controller 46. The limiter 47 has an input connected via a signal line 48 to a signal transmitter (not shown) and has a signal output connected to the controller 41 to feed a correction signal to the controller 41. The signal output can also be connected to the adding point 36 instead of to the controller 41.

The arrangement operates as follows.

The signal which comes from the temperature measuring means 37 and represents the steam temperature in the drum 8 forms, together with the difference signal fed-in via the signal line 40, a setpoint value for the temperature at the outlet of the feed water preheater 5 as measured by the temperature measuring means 35. If this temperature exceeds the formed setpoint value, the feed valve 4 is operated by the controller 41 in the opening sense, so that the amount of feed water flowing through the feed water preheater 5 becomes larger. If the steam production in the evaporator 11 does not change, the level in the steam-water drum 8 rises as a consequence of the operation of the feed valve 4. The throttling means 32 is then operated from the level measuring means 45 in the opening sense via the controller 46, which preferentially has PI behavior. Thereby, heat or more heat, if the throttling means 32 was already in the open position, is returned to the feed water tank 1. Thus, the pressure and the temperature in the tank 1 rise. As a consequence, the output signal of the temperature measuring means 25 connected to the feed line 2 increases, whereby the three-way valve 24 is changed so that a larger portion of the condensate coming from the condenser 20 is conducted past the condensate preheater 23 via the bypass line 27. Thus, less extraction steam is removed from the steam turbine 18, so that the power output of the turbine 18 increases.

It may happen that under certain operating conditions, the level in the steam-water drum 8 does not reach a threshold value set at the limiter 47 by means of the signal fed-in via the signal line 48. In that case, the limiter 47 transmits a correction signal to the controller 41 which dominates over the signal coming from the temperature measuring means 35 and influences the valve 4 in the opening sense.

Referring to FIG. 2, wherein like reference characters indicate like parts as above, the steam generator may be of the forced circulation type wherein the feed water preheater 5 is connected via the line 7 directly to a heating surface 50, in which the evaporation and subsequently the superheating of the working medium take place. In this generator a temperature measuring means 52 is connected to the heating surface 50 in the region of incipient superheating and has a signal output which is connected to a temperature controller 53 with a PI-characteristic. A setpoint value for the temperature measured by the temperature measuring means 52 is fed to the controller 53 via a signal line 54.

The line 30 is connected directly to the line 7 connecting the preheater 5 to the heating surface 50. This branch line 30 leads via a condensate preheater 55 which is arranged in the bypass line 27 circumventing the condensate preheater 23, to the feed water tank 1 and again ends as a distributor pipe 33 below the water level. Besides the throttling means 32, a flow meter 56 is disposed in the line 30. This flow meter 56 has a signal output which leads to a comparator device 58. A similar flow meter 57 is disposed in the feed line 2 between the feed pump 3 and the feed valve 4 and has a signal output which also leads to the comparator device 58. On the basis of the measuring signals of the two flow meters 56 and 57, a difference signal, which corresponds to the amount of working medium flowing into the heating surface 50, is formed in this comparator device 58. The difference signal is fed to the actual-value input of a flow controller 60 with PI-characteristic, to which the output of the temperature controller 53 is connected as the setpoint value. The output of the flow controller 60 is connected in a positive sense to the controller 41 which influences the feed valve 4 and in a negative sense to the controller 46 which influences the throttling valve 32.

The setpoint value for the temperature measured by the temperature measuring means 35 is determined on the basis of the pressure in the region of the evaporating working medium. To this end, a pressure gauge 70 is connected to the line 7 and has a signal output which is connected to a function generator 71. The function generator 71 forms a signal which corresponds to the saturated-steam temperature belonging to the measured pressure or to a temperature a given amount below the pressure. This signal forms the setpoint value of the temperature measured by the temperature measuring means 35. The signal outputs of the temperature measuring means 35 and of the function generator 71 lead to a comparison point 72, where any deviation of the two signals is formed. This deviation is fed with the same sign to each of the adding points 61 and 62 and is then passed on to the controllers 41, 46, respectively, while being superimposed on the output signal coming from the flow controller 60.

As shown in FIG. 2, the three-way valve 24 is influenced by a pressure gauge 75 connected to the condensate line 21 in a sense such that the amount of condensate flowing through the condensate preheater 55 is increased with increasing pressure in the feed water tank 1, while at the same time the amount of condensate flowing through the condensate preheater 23 is decreased and vice versa.

If the load is lowered, the arrangement works as follows, assuming that the steam turbine is run in the sliding pressure operation. Because the heat supply on the gas side is less because of the lowered load, the temperature measured by the temperature measuring means 52 in the heating surface 50 drops. Thus, the input signal of the flow controller 60 becomes smaller. This has the consequence that the feed valve 4 is operated via the controller 41 in the closing sense and the throttling means 32 via the controller 46 in the opening sense. This reduces the amount of working medium flowing into the heating surface 50 and the temperature measured by the temperature measuring means 52 settles to the new setpoint value which is fed to the temperature controller 53 via the signal line 54 and corresponds to the lower load.

In spite of the smaller heat supply on the gas side, the incident heat is changed but little in the feed water preheater 5. If the reduction of the amount of feed water just compensates this reduction of the heat incidence, the temperature of the feed water at the exit of the preheater 5, as measured by the temperature measuring means 35, does not change. Thus, the measuring means 35 does not cause any action on the feed valve 4 and the throttling means 32. If the heat incidence on the feed water preheater 5 remains about the same, so that the reduction of the amount of feed water is not compensated, then the temperature measured by the temperature measuring means 35 rises and, due to this larger temperature signal, the feed valve 4 is opened somewhat while simultaneously the throttling means 32 is opened somewhat, so that the circulation via the line 30 increases to almost the old value.

Because of the smaller heat supply of the heating gas, less steam is produced which, due to the assumed sliding pressure operation, leads to a lowering of the pressure measured by the pressure gauge 70. As a consequence, the setpoint value for the temperature measured by the temperature measuring means 35, formed in the function generator 71, is decreased. The feed valve 4 and the throttling means 32 are therefore operated in the opening sense until the temperature measured by the temperature measuring means 35 corresponds to the new setpoint.

It is also possible to realize the invention in a gas-heated steam generator, in which the steam is generated in two different pressure stages, so that two gas-heated preheaters, two evaporators and, as the case may be, two superheaters are provided. The control means according to the invention then uses a line with the temperature measuring means and the means for influencing the amount of feed water in both preheaters.

What is claimed is:

1. A steam generator comprising
   - an evaporator for evaporating feed water to steam, said evaporator being disposed in a flow path of hot gas;
   - a feed water preheater disposed in said flow path downstream of said evaporator relative to the flow of hot gas for preheating a flow of feed water therein;
   - a tank containing feed water;
   - a feed pump connected between said tank and said preheater for pumping feed water from said tank to said preheater;
   - a line connected between said preheater and said evaporator for taking off heated feed water, said line being connected to said tank to deliver heated feed water thereto;
   - a throttling means in said line for controlling the flow of heated feed water delivered to said tank; and
   - control means for increasing the amount of feed water flowing through said preheater and said line in response to an increase in temperature of the feed water in said preheater and for decreasing the amount of feed water in response to a decrease in temperature of the feed water in said preheater, said control means including a temperature measuring means for measuring the temperature of the feed water passing from said preheater.

2. A steam generator as set forth in claim 1 wherein said control means further includes a control valve between said pump and said preheater for controlling the amount of feed water pumped to said preheater, said temperature measuring means being connected to said control valve to open said valve in response to an increase in temperature of the feed water in said preheater and to close said valve in response to a decrease in temperature of the feed water in said preheater.

3. A steam generator as set forth in claim 1 which further comprises a steam/water drum connected between said preheater and said evaporator, and wherein said control means further includes a level measuring means for measuring the level of water in said drum, said level measuring means being connected to said throttling means to increase the flow of heated feed water to said tank in response to an increase in water level in said drum and to decrease the flow of heated feed water to said tank in response to a decrease in water level in said drum.

4. a steam generator as set forth in claim 3 wherein said control means further includes a control valve between said pump and said preheater for controlling the amount of feed water pumped to said preheater, said temperature measuring means being connected to said control valve to open said valve in response to an increase in temperature of the feed water in said preheater and to close said valve in response to a decrease in temperature of the feed water in said preheater.

5. A steam generator as set forth in claim 3 wherein said control means further includes a control valve between said pump and said preheater for controlling the amount of feed water pumped to said preheater and a limiter connected between said level measuring means and said control valve to receive a signal from said level measuring means representative of the level of water in said drum and to deliver a correction signal to said control valve to open said valve in response to a decrease in water level in said drum.

6. A steam generator as set forth in claim 1 wherein said control means includes a controller connected to said temperature measuring means to receive a signal therefrom representative of the temperature of the feed water in said preheater and a second temperature measuring means connected to said controller to deliver a set point signal thereto representative of the temperature of the saturated steam in said evaporator.

7. A steam generator as set forth in claim 6 wherein said controller includes an input to receive a load-dependent signal from a signal transmitter.

8. A steam generator as set forth in claim 1 wherein said control means further includes a pressure gauge connected to said evaporator to measure the pressure of the feed water delivered thereto, a controller for controlling the flow of feed water to said preheater and having a set point input, and a function generator having an input to receive a signal from said pressure gauge representative of the saturated steam pressure in said evaporator and an output connected to said input of said controller to deliver a signal thereto representative of the saturated steam temperature as a function of the measured saturated steam pressure.

9. A steam generator as set forth in claim 8 wherein said control means further includes a first flow meter for measuring the flow of feed water pumped to said preheater, a second flow meter measuring the flow of heated feed water in said line to said tank, a flow controller connected to each of said meters to receive a flow measurement signal from each, and a second temperature measuring means connected to said evaporator in a region of incipient superheating to measure the temperature thereat and to deliver a representative signal to said flow controller, said flow controller having an output connected to said controller for delivering a signal thereto to increase the flow of feed water to said preheater in response to an increase in temperature in said evaporator.

10. A steam generator as set forth in claim 2 wherein said temperature measuring means is connected to said throttling means to increase the flow in said line in response to an increase in temperature of the feed water in said preheater and to decrease the flow in said line in response to a decrease in temperature of the feed water in said preheater.

* * * * *